United States Patent [19]

Højberg

[11] Patent Number: 4,502,813

[45] Date of Patent: Mar. 5, 1985

[54] ASPHALT LAYING MACHINE

[75] Inventor: Svend Højberg, Vejen, Denmark

[73] Assignee: A/S Phønix, Tagpap og Vejmaterialer, Vejen, Denmark

[21] Appl. No.: 327,708

[22] Filed: Dec. 4, 1981

[30] Foreign Application Priority Data

Dec. 16, 1980 [DK] Denmark ..... 5341/80
Feb. 24, 1981 [DK] Denmark ..... 824/81

[51] Int. Cl.[3] ..... E01C 19/38

[52] U.S. Cl. ..... 404/102; 404/118; 74/836

[58] Field of Search ..... 404/114, 118, 119, 120, 404/101, 105, 102, 133; 74/571, 836, 571 R, 839, 571 L, 571 M

[56] References Cited

U.S. PATENT DOCUMENTS

| | | | |
|---|---|---|---|
| 2,138,828 | 12/1938 | Barber | 404/114 X |
| 2,351,592 | 6/1944 | Barber | 404/114 |
| 3,316,821 | 5/1967 | Davin | 404/114 |
| 3,396,642 | 8/1968 | Martinson | 404/114 |
| 3,838,933 | 10/1974 | Lehman et al. | 404/114 |
| 4,249,424 | 2/1981 | Glazier | 74/836 |
| 4,313,690 | 2/1982 | Hojbjerg | 404/114 |
| 4,343,568 | 8/1982 | Kaltenegger | 404/114 X |
| 4,345,852 | 8/1982 | Goto | 404/114 |

FOREIGN PATENT DOCUMENTS

| | | |
|---|---|---|
| 82410 | 3/1957 | Denmark . |
| 142178 | 12/1977 | Denmark . |
| 971591 | 2/1959 | Fed. Rep. of Germany . |
| 1459670 | 11/1968 | Fed. Rep. of Germany . |
| 437174 | 2/1912 | France . |
| WO79/00092 | 6/1979 | PCT Int'l Appl. . |
| 405501 | 12/1978 | Sweden . |
| 1054151 | 1/1967 | United Kingdom . |
| 1311711 | 3/1973 | United Kingdom . |
| 1447385 | 8/1976 | United Kingdom . |
| 2010364 | 6/1979 | United Kingdom . |

*Primary Examiner*—Stephen J. Novosad
*Assistant Examiner*—Mark J. Del Signore
*Attorney, Agent, or Firm*—Cushman, Darby & Cushman

[57] ABSTRACT

The asphalt laying machine comprises a rear body divided into sections with smoothing and compacting units suspended through vibration dampers in the frame. Each unit comprises an intermediate part and a smoothing part interconnected by means of a rear shaft bearing and a front connecting rod connected to an eccentric. By virtue of this interconnection an elliptical movement is transferred to the smoothing part during operation of the machine, and this movement produces a heavy tamping at the front edge, a smoothing and vibrating effect at the intermediate area of the ironing plate, and a succeeding tamping and polishing effect at the rear edge area. The tamping foot of a scraper plate suspended on the intermediate part tamps laid asphalt synchronously in opposition to the tamping plate of the ironing plate by virtue of reaction forces transferred through the intermediate part. During the operation of the machine, the smoothing and compacting unit ensures an unusually densely compacted and uniform surface of the asphalt.

9 Claims, 7 Drawing Figures

ASPHALT LAYING MACHINE

Figure 1:
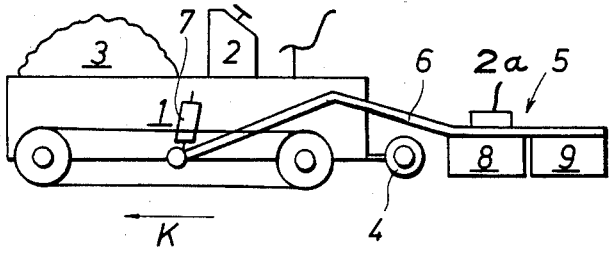

The invention relates to an asphalt machine with a rear body preferably divided into screed sections, each section comprising at least one smoothing and compacting unit, whereby the or each smothing and compacting unit is connected to a carrier frame by means of vibration dampers. This rear body compacts and smooths the asphalt mass laid by the machine, the forward position of the rear body being provided with means for distributing asphalt material, which may be additionally distributed and levelled to a plane course by means of a scraper plate before the asphalt material is compacted and smoothed by a screed plate.

U.S. Pat. No. 4,313,690 discloses an asphalt laying machine of the above type, whereby the smoothing and compacting unit with scraper plate is shaped as one unit suspended in vibration dampers. The front vibration damper, seen in the advancing direction, may be more resilient than the rear vibration damper, seen in the driving direction. By means of rotating, eccentric weights suspended on the individual sections, each smoothing and compacting unit may be caused to vibrate both horizontally and vertically.

Rear bodies are furthermore known, which in front of the vibrating screed plate comprise a tamping knife of a width of about 40 mm and having a stroke of about 4–7 mm. This tamping knife must not extend more than about 0.4 mm under the lower plane of the screed plate, which requires a very accurate guiding which can be difficult to perform in connection with such a heavy machinery. Since the tamping knife must be located adjacent the screed plate, asphalt is sucked upwards between the knife and the screed plate. Especially such a case requires that the screed plate comprises a very plane and well maintained smoothing surface.

Finally, a rear body is known, the screed plate of which is a steel plate. A short distance in front of the rear edge this steel plate comprises a recess acting as hinge joint. The front part of the steel plate is moved upwards and downwards in such a manner that in fact it only tampers and does not vibrate the laid asphalt. This known rear body comprises no rubber bushings for its connection to the frame, whereby heavy vibrations are transferred to the carrying parts and consequently to the relatively sensitive instruments. Experience has taught that this asphalt laying machine requires a particular care on behalf of the user in order to obtain a dense compacting of the asphalt. This is inter alia due to the fact that the screed plate cannot be moved forward and backward. This machine also requires a very plane and well maintained screed plate. None of these known machines comprises means permitting an extra compacting of the asphalt at the rear edge of the screed plate.

Especially the so-called combination machines, i.e. machines permitting both tamping and vibration, involve a great risk of irregular compacting since the vibration of the tamper and of the screed plate is driven by a motor each, i.e. asynchronously, which implies that resonance phenomena in the screed plate cause islands showing a weaker compacting.

It is known that the rear bodies of asphalt laying machines may be laterally broadened permitting a couse width of up to 6 m.

This extension is obtained by the rear body being divided into three screed sections. The side screed sections are displaceably suspended on the intermediate section, and the present invention deals in particular, but not exclusively, with such asphalt laying machines.

The object of the present invention is to provide an asphalt laying machine, whereby simple means permit obtainment of a uniform compacting not previously obtainable, at the same time as the degree of compacting is higher than previously obtainable and the surface is more even.

The asphalt laying machine according to the invention is characterized in that each smoothing and compacting unit is divided into an intermediate part and a smoothing part located under and hinged to said intermediate part at two points, and wherein the intermediate part and the smoothing part are interconnected by means of a moving mechanism in such a manner that the individual points of the smoothing part relative to the upper carrier fram are reliably guided along elliptical paths having short axes, whereby the elliptical axes are preferably shorter at the rear edge of the smoothing part than at the front edge thereof, whereas the individual points of the intermediate part in response to the movement of the smoothing part may be moved either synchronously in phase opposition along corresponding elliptical paths or only forward and backward along a substantially horizontal displacement path.

As a result, the front edge of the smoothing part may be given a relatively great tamping length, from 0 to about 4 mm, so that its front portion acts as a tamper, whereas the lower portion of the smoothing part and of the screed plate has a gradually decreasing vertical tamping length which due to a relatively short vertical tamping length at the rear edge of the screed plate is preferably less than 1 mm, and presses downwards in phase opposition to the front edge, whereby an additional compacting of the asphalt is achieved. The elliptic movement causes the screed plate of the smoothing part to move a short distance, e.g. 1–2 mm, forwards and backwards in horizontal direction in such a manner that it acts as a polishing board and makes the surface of the asphalt unusually even and uniform. It is furthermore ensured that the tamping and the polishing are synchronously carried out in such a manner that the forces employed for this purpose do not counteract each other. The movement in phase opposition of the intermediate part and the smoothing part implies that they can counteract each other in such a manner that the movements of the smoothing part is only transferred through the mutual connections thereof to the intermediate part. At the intermediate part, the movements are additionally dampened by means of the vibration dampers so that only very limited parts of the movements are thereby transferred to the carrier frame which is sometimes provided with rather sensitive instruments. In the case where the intermediate part can only be moved forward and backward along a horizontal displacement path, it is ensured that the tamping can be carried out by the total weight of the smoothing part and the intermediate part. In this manner the tamping can be carried out with an increased weight deriving from the synchronized vibration forces.

For constructional reasons it is advantageous to place the eccentric and the associated, driven shaft in the intermediate part of the individual smoothing and compacting units.

Furthermore it is advantageous that the eccentric drive is adjustable and constructed in the manner such that all the drives are equally adjusted through a common adjusting medium. This adjustment may be carried out during the running of the machine while observing the result of the laying procedure.

According to one embodiment of the invention the eccentric movement is transferred to the connecting rod through a guide ring located on the shaft whereby the displacement of the skew ring ensures that the guide ring tilts about the link bearing and thereby converts the adjusted longitudinal displacement of said skew ring into a substantially vertical displacement of the connecting rod. In this manner the stroke of the connecting rod can be varied between for instance 0 and about 6 mm and thereby be accurately adapted to the prevailing circumstances.

The tamper of the scraper plate extends obliquely downwards towards the screed plate of the smoothing part, whereby a more controlled feeding of the asphalt mass to the plate is ensured. As a result, the tamper cooperates in ensuring a more uniform and dense compacting as well as a more plane surface of the asphalt. In addition, the asphalt mass which may have penetrated to the space above the tamper foot is, of course, caused to slide towards the opening and thereby out of said space.

Compared to the previous asphalt laying machines, a pre- and a succeeding compacting of the asphalt is obtained, which was not possible by said known machines. The surface of the asphalt laid according to the invention is furthermore unusually uniform, which is due to the fact that the "looser" suspension of the screed plate implies that a transfer of vibrations from one section to another is avoided or at least reduced, said vibrations otherwise involving areas in the vibration area with a particularly heavy or a particularly weak compacting, cf. above. This relatively heavy forward and backward movement furthermore ensures that minor errors in the under-surface of the ironing plate are of minor importance.

Figure 2:
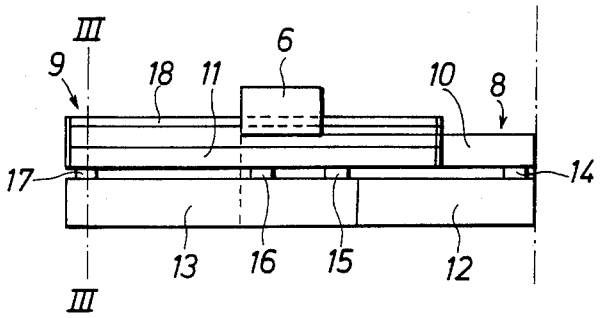
Figure 3:
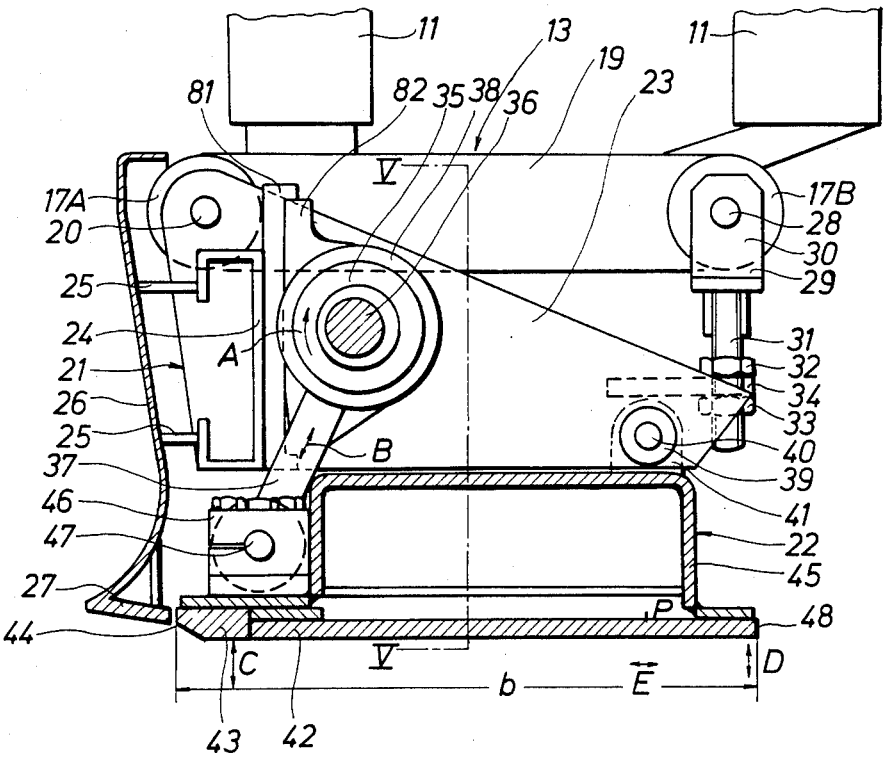
Figure 4:
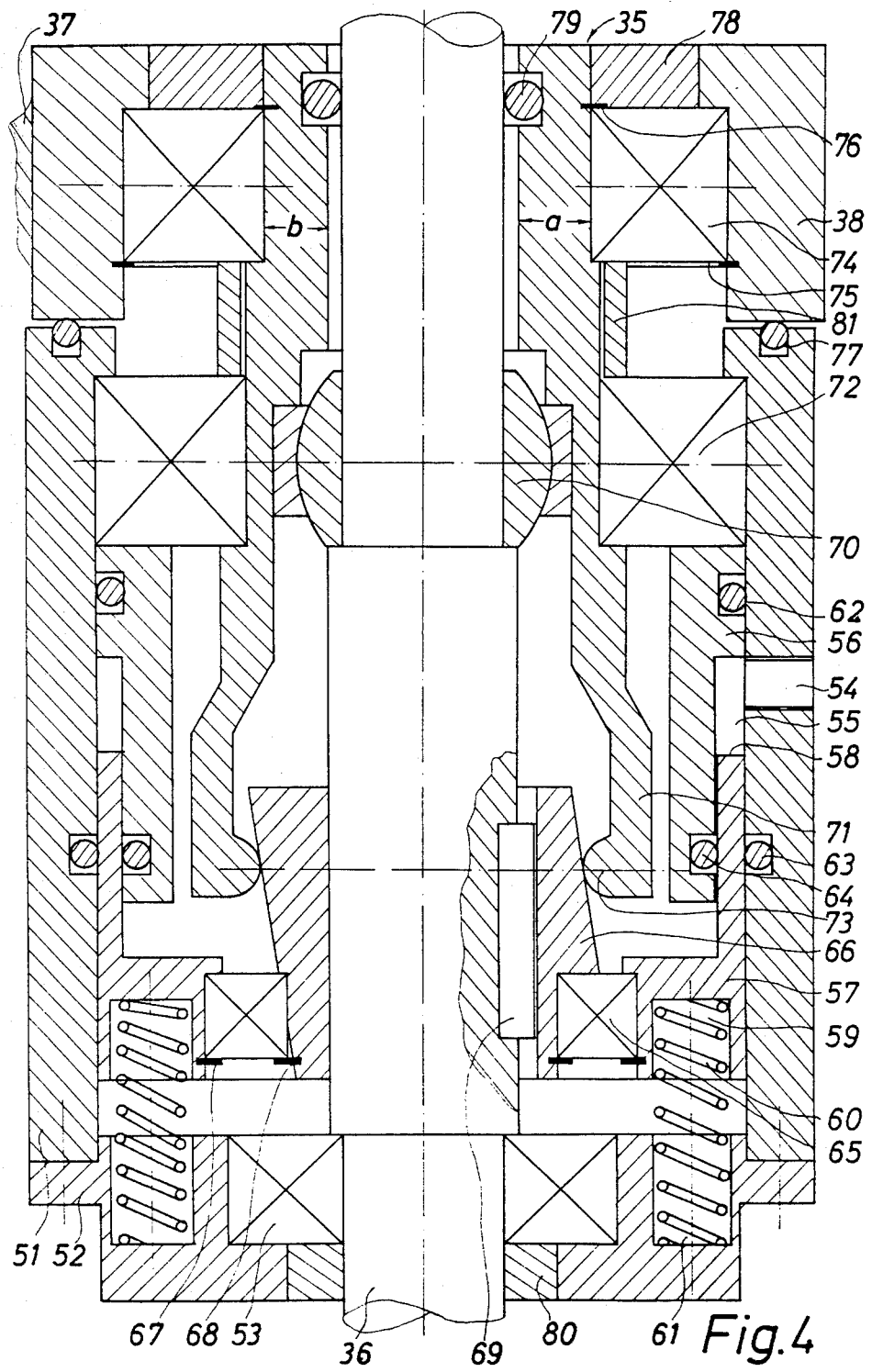
Figure 6:
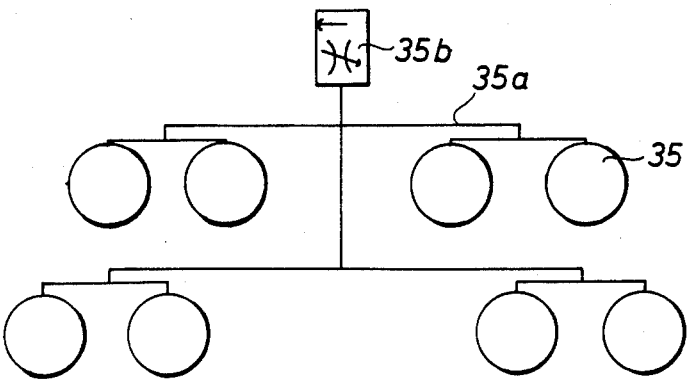
Figure 5:
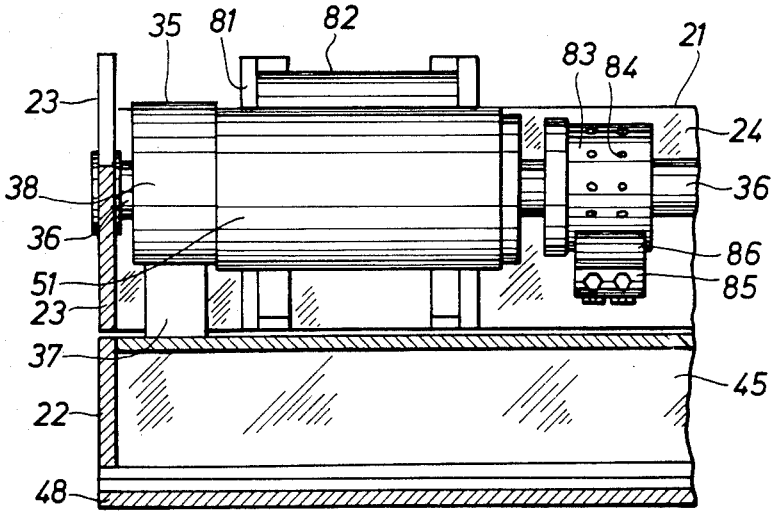
Figure 7:
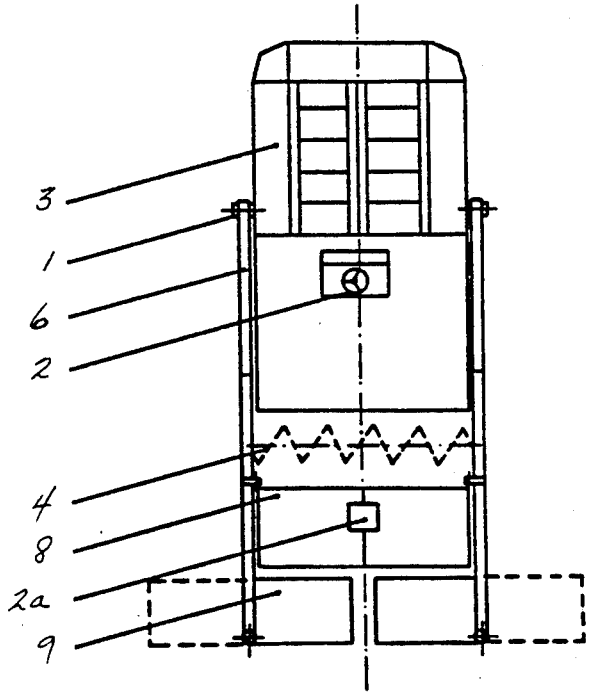

An example of an embodiment of the asphalt laying machine according to the invention will be described below with reference to the accompanying drawing, in which FIG. 1 is a diagrammatic, side view of a known asphalt laying machine, FIG. 2 is a diagrammatic, rear view of the rear body of the asphalt laying machine of FIG. 1, FIG. 3 is a sectional view taken substantially along the line III—III of FIG. 2 through an embodiment of the asphalt laying machine according to the invention, FIG. 4 is on a larger scale a longitudinal sectional view through an embodiment of an eccentric drive used in the embodiment of the asphalt laying machine according to the invention, FIG. 5 is a sectional view taken along the line V—V of FIG. 3, seen in the arrow direction;

FIG. 6 is a diagrammatic view of a hydraulic system for adjusting the eccentric drives; and FIG. 7 is a diagrammatic plan view of the asphalt laying machine shown in FIGS. 1 and 2.

FIG. 1 shows schematically an asphalt laying machine a known from U.S. Pat. No. 4,313,690 with an engine capable both of driving the asphalt laying machine forward in the direction of the arrow K, and of generating a hydraulic pressure to control the movable parts, cf. above. The machine is controlled from a control desk 2, and in front it is provided with a platform for receiving asphalt material 3 which by means of a conveyor belt not shown is passed down to a worm 4 for distribution of asphalt material in front of a rear body 5. This rear body compacts and smooths the asphalt material to a finished asphalt course. The rear body 5 is suspended on both sides of the machine in arms 6, the free ends of which are pivotably mounted on the base frame of the machine so that the height of the rear body 5 is adjustable by means of a hydraulic cylinder 7 associated with each arm. In the embodiment shown the rear body 5 is symmetric in relation to a median plane M, see FIGS. 2 and 7, of the machine in its direction of travel. In the embodiment shown the rear body 5 is symmetric in relation to a median plane M, cf. FIG. 2 and FIG. 7, of the machine in its direction of travel. FIG. 2 shows only the left half of the machine. The rear body 5 comprises a centrally placed main screed 8, and on either side of said median plane and rearward in relation to said main screed, two side screeds 9, of which only one is shown in FIG. 2. These side screeds 9 are essentially as said main screed 8 as shown in FIG. 7, and may be moved, for instance hydraulically, laterally of the side boundary of the main screed 8 for increasing the width of the asphalt course laid. The transport position of the side screeds 9 is shown in solid line in FIG. 7, and the extreme lateral position is shown in dotted lines in FIG. 7.

FIG. 2 shows to the left of the median plane of the machine, the main and side screeds 8 and 9, respectively, whereby the left side screeds 9 is shown displaced somewhat to the left. The main screed 8 comprises a rigid first frame 10 secured to arms 6 whereof only one is shown in FIG. 2. These arms 6 extend rearwardly in relation to the frame 10 with the purpose of guiding and carrying a rigid second frame 11 of the side screeds 9 so as to make said side screeds displaceable in parallel with the main screed 8 and immediately behind it as shown in FIG. 7. This is achieved by attaching ends of the second frame 11 to one or more smooth shafts 18 adapted to slide in associated bushings at the rearward ends of the arms. Hydraulic means not shown may be used for displacing the second frame 11 relative to the first frame 10 to positions between an outer position where an asphalt course laid has a maximum width and an inner position where the asphalt course laid has a minimum width. The frames 10 and 11 as well as the corresponding frames to the right of the median plane M are rigidly interconnected under all circumstances. The rear body is divided into a plurality of screed sections, so that each frame has associated therewith at least one particular smoothing and compacting unit 12, 13 the unit 12 of the main screed being connected to the associated frame 10 through a plurality of vibration dampers 14, 16 and the unit 13 being connected to frame 11 of a side screed by vibration dampers 15, 17, of which only the rearmost are shown in FIG. 2. Further details of such vibration dampers are explained below in connection with FIG. 3. The operation of the machine may be supervised and adjusted from a control desk 2*a* comprising adjusting and supervising means, not shown, and mouted on the frame 10, see FIG. 7, said adjusting and supervising means controlling and adjusting the width of the course laid.

The asphalt laying machine according to the invention comprises the same main parts as described above, however, the individual smoothing and compacting units 12, 13 are according to the invention constructed in a new manner, and FIG. 3 is a sectional view of a smoothing and compacting unit 13 of one of the side screeds 9. The main screed 8 and the other side screed are according to the invention constructed in the same manner as shown in FIG. 3. This unit 13 is suspended on the rigid frame 11 of the side screed 9 by means of brackets 19, one of which is shown in FIG. 3, and four vibration dampers 17A and 17B, of which only two are shown in FIG. 3. The corresponding unit of the main screed is correspondingly suspended on the frame 10. The vibration dampers are preferably of the type described in U.S. Pat. No. 4,313,690, to which reference is made. In a manner not described in details herein, these vibration dampers comprise a bushing secured on the bracket 19, an elastic sleeve with a bore for a shaft 20 secured in the bracket 19 and a bracket not parallel thereto being provided in said bushing. The sleeve of the front vibration damper 17A may, if desired, be made of a more elastic material than that of the sleeve of the rear vibration damper 17B. The smoothing and compacting unit 13 is divided into two parts, an intermediate part 21 and a lower smoothing part 22, along an upper surface of a longitudinal U-shaped sectional iron 45 of the latter, see also FIG. 5. The intermediate part 21 comprises substantially a plurality of plates 23, for instance two, perpendicular to the frame and placed with one at each lateral side of the intermediate part 21, see FIG. 5, which shows a section of the smoothing and compacting unit. Between these plates, a sectional iron 24 is welded which via rods 25 carries a scraper plate 26 with a foot 27. The plates 23 are substantially triangular and comprise near the top forward end a bearing, through which the shaft 20 of the front vibration damper 17A extends.

A fork 29 with a prong 30 on both sides of the rear vibration damper is mounted on a shaft 28 of the rear vibration damper 17B. A threaded pin 31 is welded to the bottom of the fork. On this pin and by means of nuts 32, 33, a fork 34 is secured perpendicular to said pin, and this fork is furthermore welded to the plate(s) 23. In this manner the intermediate part may carry out a small pivotal movement about the shaft of the front vibration damper 17A, and thereby the angle of an ironing plate may be adjusted.

On one or on both plates 23 or on a bracket 82 secured to the sectional iron between two such plates, one or two eccentric drives 35 are located which may be driven by a driven shaft 36. The shaft extends through a corresponding intermediate part suspended in the vibration dampers 15. The shaft 36 is driven by a motor (not shown) located between the vibration dampers 15 and 17 (see FIG. 2) and is not described in detail, in such a manner that the parts (i.e. the eccentric drives 35 and the centrifugal weights 86 described hereinafter) caused to move by the shaft run synchronously.

A connecting rod 37 is connected to the eccentric drive 35 through a connecting rod bearing 38 in such a manner that the connecting rod 37 may carry out an upward and downward movement.

At the back near the bottom of the plate or between the plates 23, a bearing 39 is located having an associated axle journal 40 for pivotal (rotatable) carrying of a bracket 41, cf. below The smoothing part 22 comprises an ironing or screed plate 42, a tamping plate 43 with a chamfered front edge being secured to said second screed plate. The screed plate 42 is braced by means of a longitudinal U-shaped sectional iron 45 and carries in front a bearing block 46 with an axle journal 47, on which the free end of the connecting rod 37 is mounted. Near the back and at a predetermined horizontal distance from the rear edge 48 of the screed plate, the bracket 41 hinged at the back near the bottom to the plate 23 is welded or bolted. The bearing connection is located about $\frac{1}{4}$ to about 1/6, preferably about 1/5 of of the width b of the smoothing part 22 from the rear edge 48 thereof. The driving shaft of the eccentric is located between about $\frac{1}{8}$ and about 1/5, preferably about $\frac{1}{4}$ from the front edge 44 of the smoothing part 22.

In order to be capable of varying the stroke of the connecting rod in response to the prevailing circumstances on the asphalt laying site, it is preferred that the eccentric drive 35 is adjustable. In order to meet this requirement, the eccentric drive, cf. FIG. 4, comprises a rigid axle journal housing 51 with a cover 52 bolted thereon with a ball bearing 53 in which the shaft 36 is mounted. The axle journal housing 51 comprises a threaded hole 54 for connection to a hydraulic pipe system **35*a* as shown and schematically illustrated in FIG. 6, the pressure of which is adjustable from a pressure regulator 35*b* placed on a control desk 2*a* mounted on the frame 10. The hole 54 and consequently the pipe system communicate openly with an annular channel 55 formed between the inner cylindrical wall of the housing 51 and an annular part 56 secured to said wall and comprising a recess forming said channel 55. The first relatively thin-walled end of an annular piston 57 is mounted in the annular channel 55 in such a manner that its first narrow annular end surface 58 is actuated by the pressure applied through the hydraulic liquid. In the opposite, free, thicker, annular end of the piston 57 a plurality of cylindrical, axis-parallel blind holes 59 are provided, each hole receiving part of a pressure means. This pressure means may for instance be spiral springs 60, the opposite ends of which are received in corresponding blind holes 61 in the cover 52. For the sealing, for instance a plurality of sealing rings 62, 63, 64 are provided. In this manner the piston 57 is non-rotatably, but axially displaceably secured in the housing so that it may be in a balanced position depending on the difference in pressure between the springs 60 placed in an annulus and the adjusted hydraulic pressure. When no hydraulic pressure exists, the spiral springs 60 press the piston 57 into the bottom position in the channel 55**, upwards in FIG. 4.

A ball bearing 65 is permanently mounted on the inner surface of the thicker, free end of the piston 57. The inner cage of this ball bearing is permanently connected to one guide body in the form of a skew cylindric ring 66. The ball bearing 65 is axially retained by Seger rings 67, 68. Through a spring-groove connection 69 the skew ring 66 is axially displaceably retained on the shaft 36 so as to rotate therewith.

A guide ring 71 is by means of a link bearing or joint 70 mounted on the shaft 36 so as to rotate therewith. The intermediate part of the guide ring 71 is mounted in a spherical ball bearing 72, the outer race of which is permanently mounted in the housing 51. In the shown embodiment the guide ring 71 comprises at the end thereof facing the skew ring 66, a bead 73 being substantially hemispherical in cross section, which bead 73 bears against the oblique outer surface of the skew ring. Other embodiments may also be employed. When the piston 57 and the skew ring 66 associated therewith through the ball bearing 65 for axial displacement are axially displaced, the bead 73 is displaced along a circular arc in a substantially radial direction, and thereby tilts the guide ring 71 around the link bearing 70. The central line of the guide ring 71 thereby forms a small angle with the axis of the shaft 36.

A ball bearing 74 is mounted on the opposite end of the guide ring 71, said end projecting from the housing 51. This ball bearing 74 is surrounded by the connecting rod bearing 38 carrying the connecting rod 37. Furthermore, this ball bearing is tightened by Seger rings 75, 76.

Packings 77, 78, 79, 80 seal the parts of the eccentric drive towards the surroundings. A spacer tube 81 ensures the correct distance between the ball bearing 74 and the sperical ball bearing 72. The wall thickness of the end of the guide ring 71 carrying the connecting rod varies between the thicknesses a and b. As illustrated the thickness a may for instance be about 12 mm, whereas b for instance is 13 mm, but other thicknesses, depending on the desired material strength, may also be chosen. Thus the thicknesses may for instance vary between about 8 mm and about 9 mm. In the position shown in the drawing the center line of the guide ring 71 will thus be permanently displaced about 1 to 2 mm relative to the axis of the shaft 36, and extends in this position parallel thereto. This position is as shown the intermediate position of the piston 57 and the skew ring 66. When the piston is not influenced by hydraulic pressure, the skew ring is as mentioned displaced into its one bottom position, i.e. upwards as indicated in the drawing. The resulting tilting of the guide ring 71 around the link bearing 70 implies that the connecting rod bearing is positioned in such a manner that the connecting rod does not perform any upward and downward movement, i.e. that the eccentric 35 is zeroed. As the pressure gradually increases towards the end surface 58 of the piston, this piston 57 and the skew ring are pressed backwards against the pressure of the springs 60, i.e. downwards in FIG. 4, whereby the stroke transferred to the connecting rod 37 is gradually increased. The stroke may thereby be varied from for instance 0 to about 4 to 6 mm.

By providing the connecting rod bearing with the above permanent eccentric it is obtained that the tilting angle of the guide ring 71, i.e. the angle formed by the center line of said guide ring and the axis of the shaft 36, is maintained as small as possible.

The smoothing and compacting unit according to the invention operates in the following manner:

The asphalt material distributed by the worm 4 of the asphalt laying machine is additionally distributed by means of the scraper plate 26, cf. FIG. 3. This scraper plate is curved in such a manner that excessive hot asphalt material is again moved to the front and subsequently carried downwards, thereby being mixed with fresh asphalt material distributed by the worm and thereby maintaining the desired temperature. During the advancing, the eccentric 35 is through the shaft 36 driven in the direction of the arrow A, whereby the connecting rod is moved forward and backward as indicated by the double arrow B. In this manner the smoothing part 22 is moved upwards and downwards and forwards and backwards in a substantially elliptical movement by means of the connecting rod 37, cf. the arrows C, D, and E. Since the connecting rod is connected to the smoothing part 22 at the front end thereof, the greatest up- and downward movement is carried out at said front edge, cf. the double arrow C. This implies that the tamping plate 43 of the ironing plate 42 acts as a tamper. When the tamping plate 43 is elevated by the connecting rod 37, the entire front portion of the screed plate until the point P under the bearing of the axle journal 40 moves upwards, whereas the rear portion from the point P to the rear edge 48 moves downwards and thus theoretically a short moment carries the overhead weight. As a result, the rear edge acts as a following tamper compacting the asphalt material vigorously, so that a very dense compacting of the asphalt material is obtained since the rear edge 48 a short moment carries the major portion of the weight of at least the smoothing part 22. The stroke of the tamping plate 43 is preferably adjusted from about 0 mm to about 6 mm, and especially to 2–4 mm, whereas the stroke at the rear edge in a corresponding manner is preferably between 0 and 2 mm, and especially between 0.5 and 1 mm. The latter strokes may be achieved by a stroke of the connecting rod of 2 mm. By virtue of the location of the hinge joint 39, 40, a forward and backward movement in horizontal direction is also transferred to the screed plate 42, said movement being between 0 and about 3 mm, preferably between 1 and 2 mm in response to the adjusted stroke. In this manner an efficient forward and backward smoothing of the surface of the asphalt is obtained, so that it is additionally smoothed since especially the portion from the point P to the rear edge 48 produces a widely distributed polishing effect on the surface, whereas the portion of the screed plate situated between the tamping plate and the point P acts as a vibrator. Since the tamping plate, the vibrator and the polishing portion are driven by the same shaft in the entire length of the smoothing and compacting unit 13, it is ensured that no counteracting forces exist between the tamping function and the vibrating function.

When the smoothing part 22 is caused to move by the connecting rod 37 and the eccentric 35 and slightly rotated around the bearing 39, each point except a line through the point P performs a small elliptical movement along ellipses with short axes.

On account of reaction forces deriving from the vibration dampers 17A and 17B, the intermediate part 21 performs as a reaction to the movement of the smoothing part 22 induced by the eccentric drives 35, opposite movements, both forward and backward and upward downward, i.e. that the intermediate part moves slightly upwards when the smoothing part 22 is pressed down and the intermediate part moves slightly downwards each time the smoothing part moves upwards, and the intermediate part moved slightly to the right, cf. FIG. 3, each time the smoothing part moves to the left and vice versa. As a result, the foot 27 situated at the bottom of the scraper plate 26 acts as a pretamper running synchronously in opposition with the smoothing part 22. Thereby, the asphalt collected by the foot 27 in front of the scraper plate is slightly compacted prior to the actual compacting by means of the screed plate. This feature cooperates in increasing the total degree of compacting. Though the foot 27 may be horizontal, it is according to the invention preferred that the tamping foot 27, cf. FIG. 3 is slightly inclined with the lower inclined surface extending downwards in a direction towards the front edge 44 of the tamping plate 43. As a result, the degree of compacting obtained at the foot 27 gradually increases towards the front edge 44, so that the asphalt material already at the transition to the tamping plate 43 of the screed plate 42 is smoothed and slightly compacted, which prevents asphalt material from penetrating to the space between the front edge 44 and the foot 27.

A particularly preferred embodiment of the asphalt laying machine according to the invention is shown in FIG. 5 being a sectional view of a part of the intermediate part 21 and the smoothing part 22, as seen in the forward direction from the line V—V of FIG. 3. A sleeve 83 is in this embodiment mounted next to the shaft bearing housing 51 carried by angle irons 81 and a bracket 82, and on the shaft 36 so as to rotate therewith. A corresponding sleeve may in a similar manner be mounted on the shaft 36 next to a shaft bearing housing at the opposite end of the intermediate part 21. A plurality of radial, threaded holes 84 are drilled in the outer cylinder surface of the sleeve 83. A centrifugal weight 86 is by means of for instance four threaded bolts 82 secured on the sleeve 83, said bolts being screwed into two selected pairs of the holes 84, the centrifugal weight(s) 86 may by means of the holes 84 be secured in various angular positions. It is obvious that the centrifugal weights also may comprise a dovetailed projection adapted to be displaced in a corresponding groove in the sleeve and comprising co-operating tightening means for retaining the centrifugal weight relative to the shaft. In this manner a stepwise adjustment of the centrifugal weight is permitted.

In a first chosen angular outer position, the centrifugal weight may be secured in such a manner that the above u- and downward movement of the intermediate part 21 is counteracted and optionally completely omitted, thereby causing the intermediate part 21 with its entire weight to contribute, supported by reaction forces, to the tamping effect of the smoothing part 22 and consequently of the tamping plate 43, and also causing the intermediate part 21 and the scraper plate 26 rigidly connected thereto to be moved horizontally only and forward and back for continuously stirring the asphalt mass laid in front. Furthermore, a vibration is in addition to the tamping and smoothing movement transferred to the smoothing part, said vibration cooperating in increasing the degree of compacting of the asphalt laid in such a manner that the succeeding rolling can be minimized. In other chosen angular positions of the centrifugal weight 86, this weight limits to a greater or smaller extent the up- and downward movement of the intermediate part 21. Thus it is possible to choose the position of the centrifugal weight, which experience has taught to be the best suited for the local conditions, and by choosing the stroke of the connecting rod 37 in response to the local conditions it is possible to accurately adjust the tamping force and length of the smoothing part as well as smoothing lengths and consequently the polishing effect, and furthermore to adjust the vibration transferred to the smoothing part.

The asphalt laying machine according to the invention thus provides the following advantages the tamping effect, the polishing effect, and the vibration forces are synchronized and adjustable, the stroke of the tamping plate is adjustable from 0 to 7 mm, preferably from 0 to 4 mm, and especially from 2 to 4 mm, the screed plate may if desired at a stroke of 0 act as a usual vibration screed plate, the stroke is adjustable stepwise during the laying of the asphalt from a centrally situated regulating valve, cf. FIG. 6, to which the adjustable eccentrics are connected.

I claim:

1. An asphalt laying machine with a rear body preferably divided into screed sections, each section comprising at least one smoothing and compacting unit comprising a bracket fixedly connected to a carrier frame, an intermediate part connected to said bracket by means of vibration dampers in order to reduce transfer of vibrations to the frame, and a smoothing part having a lower rear edge and a lower front edge located under said intermediate part, said smoothing part a short distance in front of and above its lower rear edge at the rearward point being hinged to said intermediate part for limited rotational movement about this hinge, and said smoothing part at its front edge being hinged to said intermediate part by means of a moving mechanism, which includes at least one upwardly directed connecting rod and an eccentric drive therewith for providing limited elliptical movement of said moving part in relation to a surface to be smoothed, in such a manner that essentially all individual points of the smoothing part relative to an upper carrier frame are reliably moved and guided along elliptical paths having short elliptical axes, whereby these axes are preferably shorter at the rear edge of the smoothing part than at its lower front edge, whereas essentially all individually points of the intermediate part in response to the movement of the smoothing part may be moved either synchronously in phase opposition along corresponding elliptical paths or only forward and backward along a substantially horizontal displacement path.

2. An asphalt laying machine as claimed in claim 1, wherein said eccentric drive or said eccentric drives are located in said intermediate part and driven by a driven shaft located therein and common to the eccentric drives.

3. An asphalt laying machine as claimed in claim 1 and comprising at least one adjustable eccentric drive, wherein each eccentric drive for adjustment of said strokes of the connecting rod comprises a skew ring placed on said shaft to rotate therewith and axially displaceable thereon, said skew ring being situated in a balanced manner between a first and a second axially oppositely directed pressure means, the compressive force of the first pressure means being adjustable by means of a common adjusting medium located outside said eccentric drive and connected thereto, whereby said skew ring may be displaced in axial direction upon said shaft.

4. An asphalt laying machine as claimed in claim 3, wherein the skew ring is balanced between said first pressure means and said second oppositely directed pressure means by means of an annular piston maintained unrotationally and connected to said skew ring through a bearing which piston by regulating said pressures is axially displaceable in an axle bearing housing of the eccentric drive, which piston has a first terminal surface influenced by said common adjusting medium for adjusting the location of the piston, preferably hydraulic liquid, the pressure of which is centrally adjustable, said second pressure comprising at least one spring and influencing a second terminal surface of the piston and counteracting the pressure originating from the common adjusting medium.

5. An asphalt laying machine as claimed in claim 4, wherein a substantially cylindrical, axially undisplaceable guide ring is located on said shaft to rotate therewith and tiltably coupled between a link bearing and a spherical ball bearing for tilting about the center of the link bearing, one end of said guide ring through an inner, annular bead bearing against said skew ring on an outer surface thereof for tilting when said skew ring is displaced by means of said first and second pressure means, and wherein a second end of said guide ring carries said connecting rod through a connecting rod bearing for reciprocal movement of said connecting rod.

6. An asphalt laying machine as claimed in claim 5, wherein the axis of said second end of the guide ring carrying the connecting rod bearing has its axis permanently displaced relative to the axis of said shaft by said second pressure means when the skew ring is loaded only by said second non-adjustable pressure means.

7. An asphalt laying machine as claimed in claim 2, wherein at least one centrifugal weight is fastened to said shaft for movement therewith for producing vibrations in the intermediate and the lower part.

8. An asphalt laying machine as claimed in claim 1, wherein said smoothing part at its lower rear end is hinged to said intermediate part by means of at least one axle journal and a journal bearing for limited rotational reciprocal movement, said bearing connection being located about $\frac{1}{4}$ to about 1/6 of said width b of said smoothing part from said lower rear edge of said smoothing part, and that said driving shaft of said eccentric is located between about $\frac{1}{8}$ and about 1/5 from said lower front edge of said smoothing part.

9. An asphalt laying machine with a rear body preferably divided into screed sections, each section comprising at least one smoothing and compacting unit comprising a bracket fixedly connected to a carrier frame, an intermediate part connected to said bracket by means of vibration dampers, and a smoothing part having a lower rear edge and a lower front edge located under said intermediate part, said smoothing part at its lower rear edge being hinged to said intermediate part by means of at least one axle journal and a journal bearing for limited rotational reciprocal movement, said bearing being located about $\frac{1}{4}$ to about 1/6 of the width of said smoothing part from said lower rear edge of said said smoothing part, and said smoothing part at its front edge being hinged to said intermediate part by means of a moving mechanism, which includes an eccentric drive having a driving shaft which is located between about $\frac{1}{8}$ and about 1/5 from said lower front edge of said smoothing part, in such a manner that essentially all individual points of the smoothing part relative to an upper carrier frame are reliably moved and guided along elliptical paths having short elliptical axes, whereby these axes are preferably shorter at the rear edge of the smoothing part than at its lower front edge, whereas essentially all individual points of the intermediate part in response to the movement of the smoothing part may be moved either synchronously in phase opposition along corresponding elliptical paths or only forward and backward along a substantially horizontal displacement path.

* * * * *